US007473078B2

(12) United States Patent
Hisaka et al.

(10) Patent No.: US 7,473,078 B2
(45) Date of Patent: Jan. 6, 2009

(54) CENTRIFUGAL BLOWER

(75) Inventors: Koji Hisaka, Anjo (JP); Kunie Matsuoka, Nagoya (JP)

(73) Assignee: Denso Corporation, Kariya (JP)

( * ) Notice: Subject to any disclaimer, the term of this patent is extended or adjusted under 35 U.S.C. 154(b) by 441 days.

(21) Appl. No.: 11/247,849

(22) Filed: Oct. 11, 2005

(65) Prior Publication Data

US 2006/0083610 A1 Apr. 20, 2006

(30) Foreign Application Priority Data

Oct. 19, 2004 (JP) ..... 2004-304432

(51) Int. Cl.
*F04D 29/28* (2006.01)

(52) U.S. Cl. ..... 416/175; 416/203

(58) Field of Classification Search ..... 415/143, 415/198.1; 416/175, 178, 183, 187, 201 A, 416/203

See application file for complete search history.

(56) References Cited

U.S. PATENT DOCUMENTS 2,652,190 A * 9/1953 Meltzer et al. ..... 416/187
2,803,398 A * 8/1957 Sprouse ..... 416/187
3,885,888 A * 5/1975 Warhol ..... 416/175
7,201,565 B2 * 4/2007 Ku et al. ..... 416/175
2003/0077174 A1 * 4/2003 Kim ..... 416/186 R

FOREIGN PATENT DOCUMENTS

JP 2003-035298 2/2003
JP 2003-269380 9/2003
JP 3489221 11/2003

* cited by examiner

*Primary Examiner*—Edward Look
*Assistant Examiner*—Nathaniel Wiehe
(74) *Attorney, Agent, or Firm*—Harness, Dickey & Pierce, PLC

(57) ABSTRACT

A centrifugal blower includes a scroll casing defining a scroll passage having a suction port and a discharge port. A fan member is disposed rotatably in the scroll casing, and the fan member is rotated by a motor. The fan member includes a plate member having at least a first circular plate portion and a second circular plate portion which are arranged in an axial direction to have a step shape in cross section, and a plurality of blades which are arranged at an outer peripheral portion of the plate member and extend in the axial direction. Furthermore, the plate member is arranged to change a flow direction of air drawn by the fan member from the suction port in an axial direction, to a radial outside. Because the plate member is arranged in the step shape in cross section, fan noise due to disturbed air flow can be restricted.

8 Claims, 5 Drawing Sheets

CENTRIFUGAL BLOWER

CROSS REFERENCE TO RELATED APPLICATION

This application is based on Japanese Patent Application No. 2004-304432 filed on Oct. 19, 2004, the contents of which are incorporated herein by reference in its entirety.

FIELD OF THE INVENTION

The present invention relates to a centrifugal blower, more particularly, relates to a plate member (bottom plate) of a centrifugal fan.

BACKGROUND OF THE INVENTION

A centrifugal blower is used for a vehicle air conditioner, for example. In the vehicle air conditioner, air is drawn from a single suction port and is blown into plural outlets by the blower, and pressure loss is relatively large due to a bent air passage of an air conditioning duct. Therefore, a centrifugal blower of a pressure type is generally used as the blower for the vehicle air conditioner.

For example, a sirocco fan is described in JP-A-2003-35298, and a turbofan is described in JP-A-2003-269380. Furthermore, a centrifugal blower shown in FIG. 9 is described in JP-B2-3489221. The blower shown in FIG. 9 includes a boss portion 102 for fixing a motor 100, and a fan member 105 including a plate member (bottom plate) 104 for connecting plural blades 103. The bottom plate 104 is formed into a mountain shape which is lowered from a high center portion toward a peripheral portion.

In the blower of FIG. 9, the flow direction of air drawn from an axial direction is changed to radially outward by the bottom plate 104. Further, as shown in FIG. 10, air flows along the surface of the bottom plate 104. Therefore, the flow speed of air near the surface of the bottom plate 104 becomes larger, and the flow speed of upper side air far from the surface of the bottom plate 104 becomes smaller. Because the flow speed of air is different between the upper portion and the lower portion in a height direction of the bottom plate 104, the air streams at different portions collide and are disturbed. Accordingly, fan noise due to the disturbed air flow is generated.

SUMMARY OF THE INVENTION

In view of the above-described problems, it is an object of the present invention to provide a centrifugal blower which restricts fan noise generated due to air flow disturbance.

According to the present invention a centrifugal blower includes a scroll casing defining a scroll passage having a suction port, from which air is drawn, and a discharge port from which air is discharged. A fan member is disposed rotatably in the scroll casing, and is rotated by a rotation force applied from a motor. The fan member includes a plate member having at least a first circular plate portion and a second circular plate portion which are arranged in an axial direction to have a step shape in cross section, and a plurality of blades which are arranged at an outer peripheral portion of the plate member and extend in the axial direction. Furthermore, the plate member is arranged to change a flow direction of air drawn by the fan member from the suction port in an axial direction, to a radial outside.

Because the plate member is arranged to have the step shape, a difference of an air flow speed between the first and second circular plate portions of the plate member can be made smaller, and a generation of disturbed air flow can be effectively restricted. Furthermore, because the plate member constructed at least with the first and second circular plate portions have a simple step shape, the plate member can be easily molded by using a resin material.

The number of the circular plate portions constructing the plate member is not limited two, and can be set at three or more. For example, the plate member further has a third circular plate portion. In this case, the first, second and third circular plate portions are arranged in the axial direction to have a step shape in cross section.

The fan member can be provided with a plurality of centrifugal fans which are arranged on each of the first and second circular plate portions in a circumferential direction. In this case, the centrifugal fans can increase an air amount drawn from the suction port. For example, the centrifugal fan has a surface which protrudes toward the axial direction, and the protruding is made larger as toward the circumferential direction.

Furthermore, the centrifugal fans can be arranged on the first circular plate portion to have a first stage portion between two centrifugal fans adjacent to each other in the circumferential direction, and the centrifugal fans can be arranged on the second circular plate portion to have a second stage portion between two centrifugal fans adjacent to each other in the circumferential direction. In this case, the first stage portion can be made offset from the second stage portion in the circumferential direction.

In addition, the first, second and third circular plate portions can be arranged concentrically relative to an axial line. As an example, the first circular plate portion can be connected to a boss portion around the boss portion, and the second circular plate portion can be arranged at a portion shifted from the first circular plate portion in the axial direction to extend radially outward from the first circular plate portion. Furthermore, the surfaces of the first and second circular plate portions can be made approximately perpendicular to the axial direction.

BRIEF DESCRIPTION OF THE DRAWINGS

The above and other objects, features and advantages of the present invention will become more apparent from the following detailed description of preferred embodiments made with reference to the accompanying drawings, in which.

DETAILED DESCRIPTION OF PREFERRED EMBODIMENTS

Figure 1:
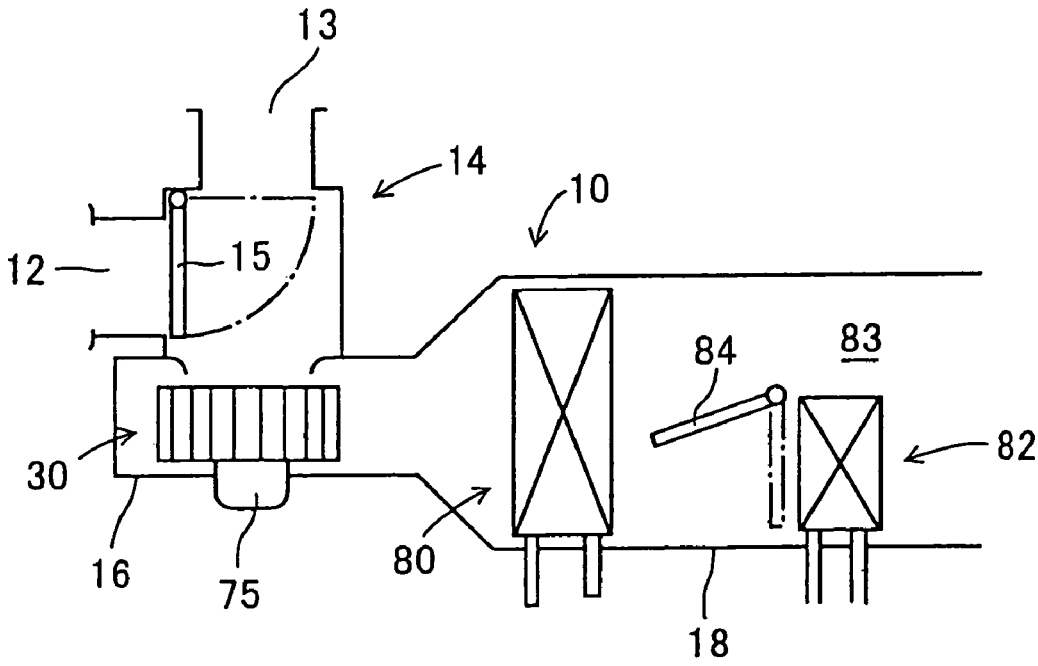
FIG. 1 is a schematic sectional view showing a vehicle air conditioner including a centrifugal blower according to a embodiment of the present invention.
Figure 2:
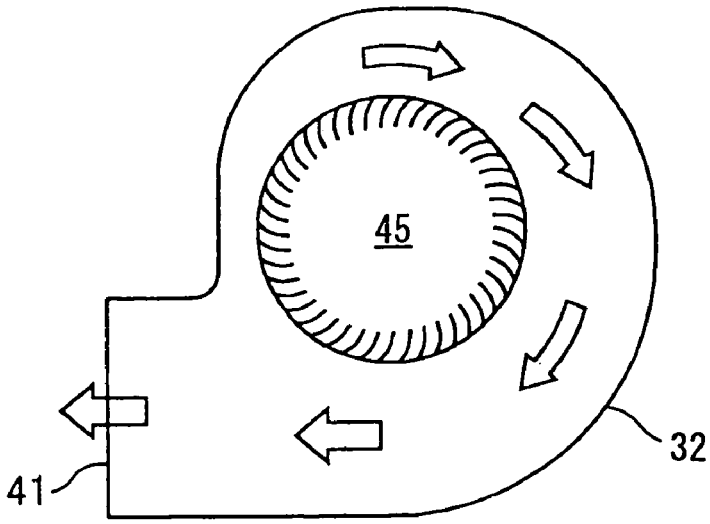
FIG. 2 is a schematic plan view showing a fan member of the centrifugal blower.

A preferred embodiment of the present invention will be now described with reference to FIGS. 1 to 7. A vehicle air conditioner includes an air conditioning duct 10 for defining an air passage through which air flows into a passenger compartment, a centrifugal blower 30 for blowing air, an evaporator 80 for cooling air sent from the blower 30, and a heater core 82 for heating air.

The air conditioning duct 10 includes an upstream end portion 16, which is provided with an inside/outside air switching box 14 and the centrifugal blower 30. The inside/outside air switching box 14 includes an inside air suction port 12 for introducing inside air (i.e., air inside the passenger compartment), and an outside air suction port 13 for introducing outside air (i.e., air outside the passenger compartment). The inside air suction port 12 and the outside air suction port 13 are selectively opened and closed by a suction port switching door 15.

The evaporator 80 and the heater core 82 are accommodated in a middle portion 18 of the air conditioning duct 10.

The centrifugal blower 30 contained in the upstream end portion 16 of the air conditioning duct 10 draws air from the suction ports 12, 13 in an axial direction, and blows the drawn air radially outwardly toward the evaporator 80 and the heater core 82.

The evaporator 80 is located in the air conditioning duct 10 at a portion downstream from the blower 30, and a heater core 82 is arranged in the air conditioning duct 10 downstream from the evaporator 80. A bypass passage 83, through which air after passing through the evaporator 80 flows while bypassing the heater core 82, is formed in the air conditioning duct 10 at a side of the heater core 82. An air mixing door 84 is located at an upstream side of the heater core 82 to open and close an air passage of the heater core 82 and the bypass passage 83.

A downstream end portion (not shown) of the air conditioning duct 10 is provided with a face opening from which conditioned air is blown toward an upper side of the passenger compartment, a foot opening from which conditioned air is blown toward a lower side of the passenger compartment, and a defroster opening from which conditioned air is blown toward an inner surface of a windshield. The face opening, the foot opening and the defroster opening are selectively opened and closed by an air-outlet mode switching door.

Figure 3:
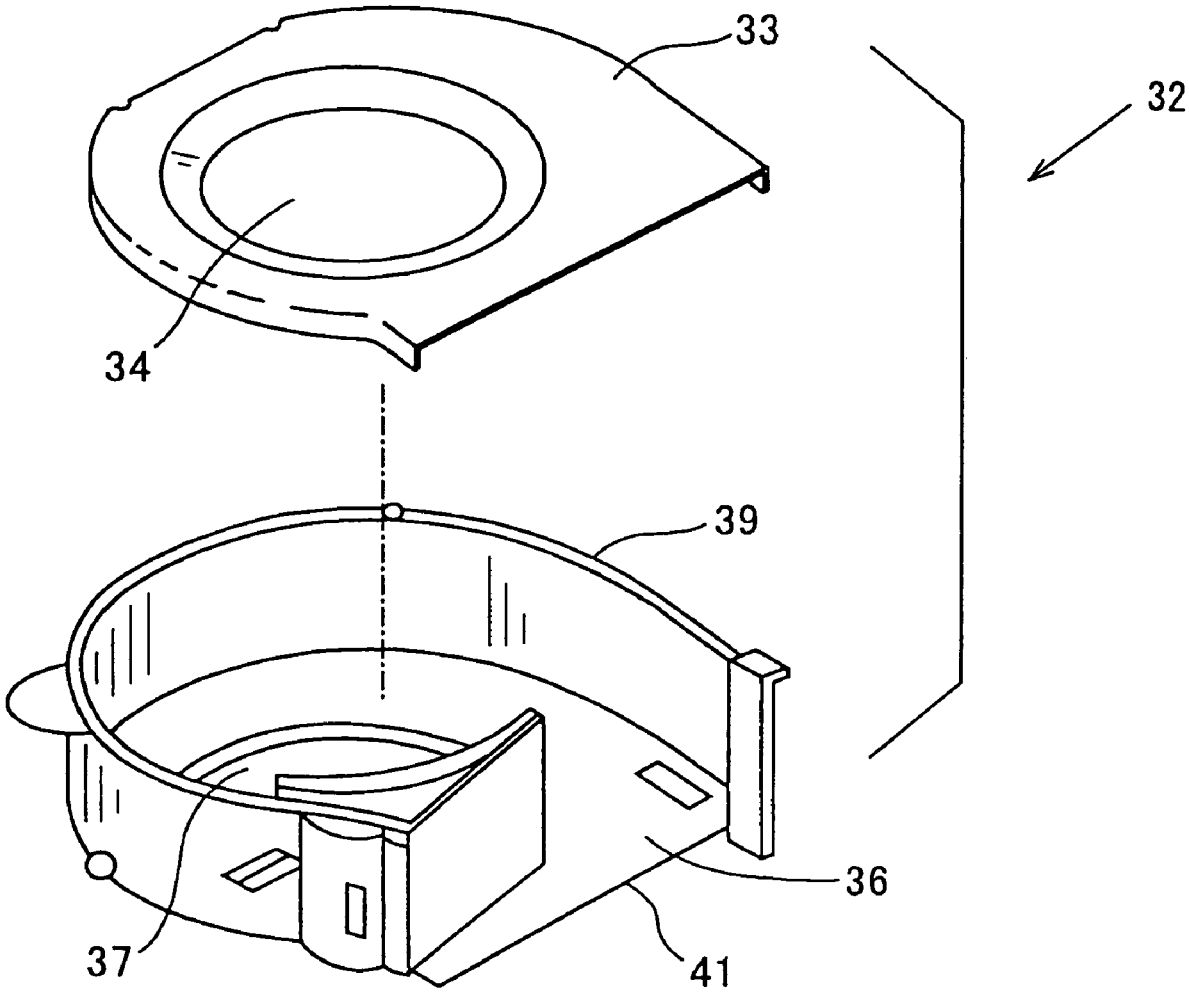
FIG. 3 is a disassembled perspective view showing a scroll casing of the centrifugal blower.

Next, the centrifugal blower 30 will be described with reference to FIGS. 2 to 7. The centrifugal blower 30 includes a scroll casing 32, a fan member 45 located in the scroll casing 32, and a motor 75 for driving the fan member 45. As an example, the centrifugal blower 30 is mounted such that an axial line of the motor 75 is position on a vertical direction as in FIG. 1. As shown in FIG. 3, the scroll casing 32 includes a scroll-shaped top wall 33, a bottom wall 36 and a side wall 39. A suction port 34, from which air is drawn, is formed in the top wall 33, and an insertion hole 37 into which the fan member 45 is inserted is formed in the bottom wall 36. The bottom wall 36 can be made to have the same shape as the top wall 33. The top wall 33 and the bottom wall 36 are connected by a side wall 39, and a discharge port 41 is formed in the side wall 39. The top wall 33, the bottom wall 36 and the side wall 39 form a scroll passage in the centrifugal blower 30.

Figure 4:
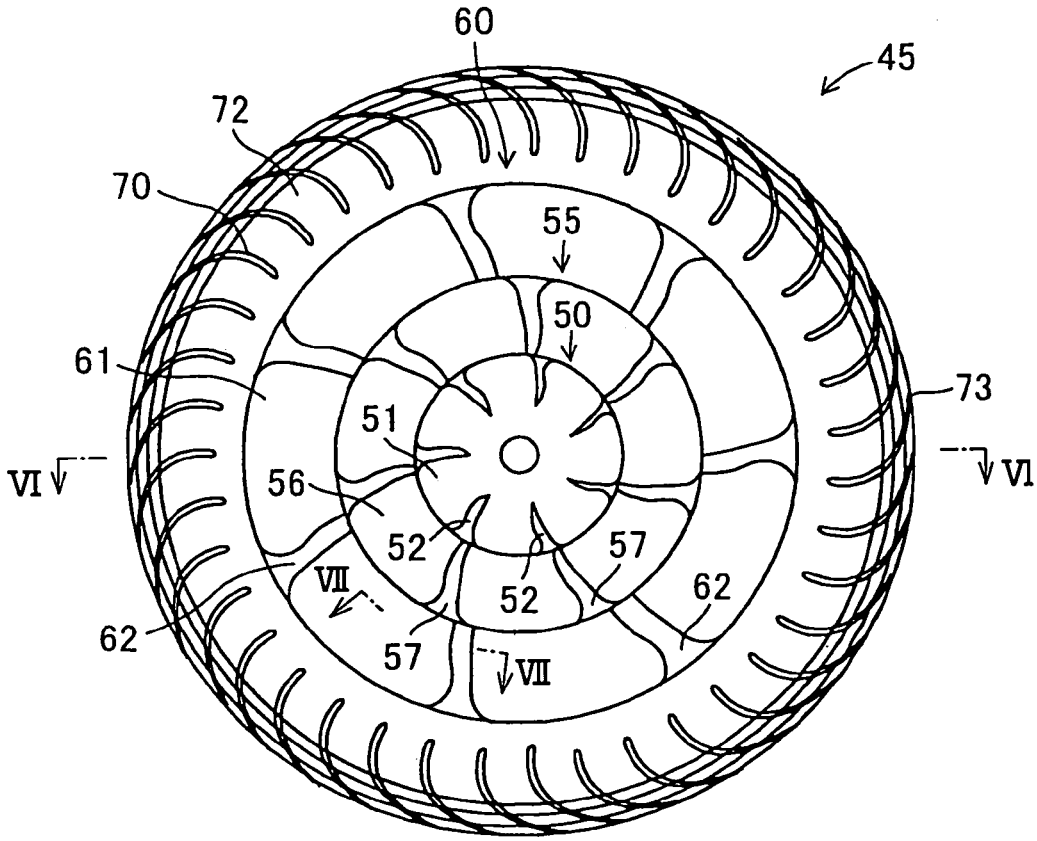
FIG. 4 is a plan view showing the fan member of the centrifugal blower.
Figure 5:
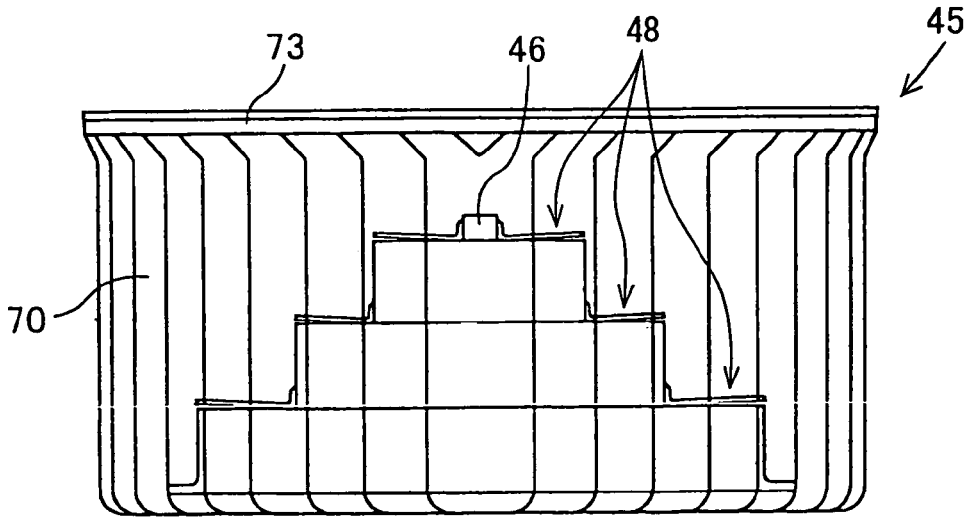
FIG. 5 is a front view of the fan member.
Figure 6:
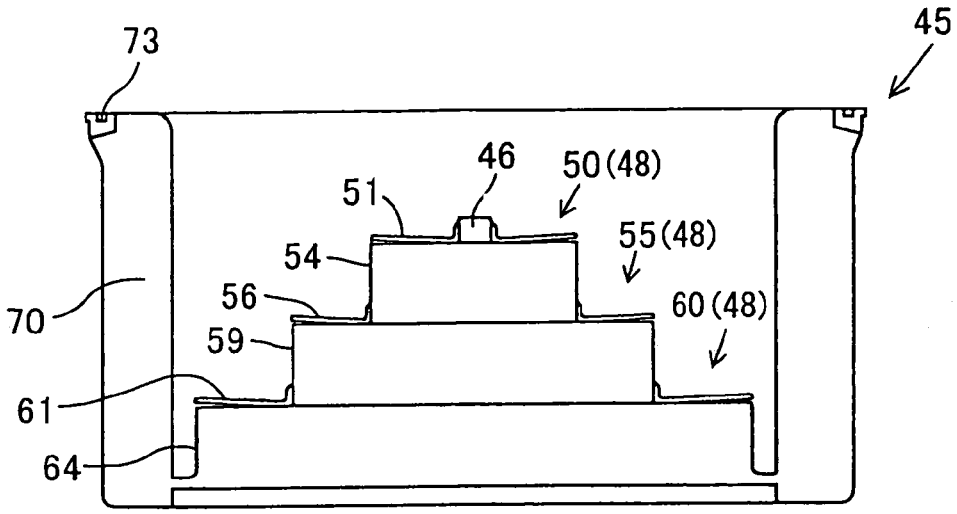
FIG. 6 is a cross-sectional view taken along line VI-VI in FIG. 4.

As shown in FIGS. 4 and 5, the fan member 45 includes a center boss 46, outer peripheral blades 70, and a plate member 48 which connects the outer peripheral blades 70 to the boss 46. The boss 46 is positioned at the center of the fan member 45 in a radial direction. In the example of FIGS. 5 and 6, the boss 46 is positioned at an upper side in the fan member 45. The plate member 48 is formed to have a step shape in cross-section, as shown in FIGS. 5 and 6. The plate member 48 includes a first circular plate portion 50, a second circular plate portion 55 and a third circular plate portion 60, which are concentrically arranged in the axial direction to have the step shape in cross section.

Each of the first to third circular plate portions 50, 55 and 66 is placed on a surface perpendicular to an axial direction of the fan member 45. The first circular plate portion 50 is positioned at a top portion of the plate member 48, the second circular plate portion 55 is positioned radially outside of the first circular plate portion 50 at a lower side of the first circular plate portion 50 in the axial direction, and the third circular plate portion 60 is positioned radially outside of the second circular plate portion 55 at a lower side of the second circular plate portion 55 in the axial direction, as shown in FIG. 6.

Furthermore, as shown in FIG. 6, a first cylindrical portion 54 is formed between the first circular plate portion 50 and the second circular plate portion 55, a second cylindrical portion 59 is formed between the second circular plate portion 55 and the third circular plate portion 60, and a third cylindrical portion 64 is formed between the third circular plate portion 60 and bottom portions of the blades 70. Therefore, the plate member 48 is formed into a step shape in a cross-section taken along in the axial direction. The step shape in cross section is higher at the center portion and becomes lower radially outside.

Plural first centrifugal fans 51 are arranged on the surface of the first circular plate portion 50 to be separated from each other in a circumferential direction of the first circular plate portion 50. Furthermore, each first centrifugal fan 51 is bent to an axial upper side as toward the circumferential direction. As a result, a stage portion 52 (step portion) extending in a radial direction is formed between adjacent first centrifugal fans 51. The stage portion 52 is provided at an end portion of each first centrifugal fan 51 in the circumferential direction, as shown in FIG. 4.

The second circular plate portion 55 extends radially outwardly from the bottom end of the first cylindrical portion 54. Plural second centrifugal fans 56 are arranged on the surface of the second circular plate portion 55 to be separated from each other in a circumferential direction of the second circular plate portion 55. Furthermore, each second centrifugal fan 56 is bent to an axial upper side as toward the circumferential direction. As a result, a stage portion 57 extending in a radial direction is formed between adjacent second centrifugal fans 56. The stage portion 57 is provided at an end portion of each second centrifugal fan 56 in the circumferential direction, as shown in FIG. 4. The dimension of the second centrifugal fan 56 is different from the first centrifugal fan 51, but the structure of the second centrifugal fan 56 is similar to the first centrifugal fan 51.

Figure 7:
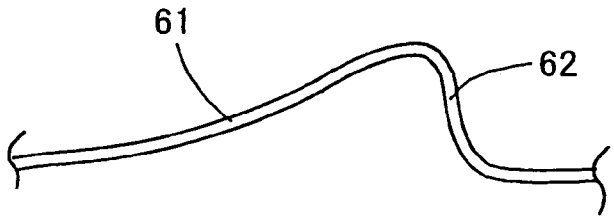
FIG. 7 is a cross-sectional view taken along line VII-VII in FIG. 4.

The third circular plate portion 60 extends radially outwardly from the bottom end of the second cylindrical portion 59. Plural third centrifugal fans 61 are arranged on the surface of the third circular plate portion 60 to be separated from each other in a circumferential direction of the third circular plate portion 60. Furthermore, each third centrifugal fan 61 is bent to an axial upper side as toward the circumferential direction. As a result, a stage portion 62 (see FIG. 7) extending in a radial direction is formed between adjacent third centrifugal fans 61. The stage portion 62 is provided at an end portion of each third centrifugal fan 61 in the circumferential direction, as shown in FIGS. 4 and 7.

The dimension of the third centrifugal fan 61 is different from the second centrifugal fan 56, but the structure of the third centrifugal fan 61 is similar to the second centrifugal fan 56. Furthermore, as shown in FIG. 4, the first, second and third stage portions 52, 57, 62 are offset from each other in the circumferential direction.

The plural blades 70 are arranged at an outer peripheral portion of the third cylinder portion 64 to be elongated in the axial direction. Each blade 70 is constructed with a smoothly bent sirocco fan or a turbofan. Furthermore, each blade 70 has a predetermined angle relative to a normal direction of the fan member 45, and a clearance 72 is formed between adjacent blades 70. The top portions of the blades 70 are connected by a circular connection portion 73.

The motor 75 shown in FIG. 1 is arranged at a lower side of the plate member 48, and the boss 46 is connected to the rotation shaft of the motor 75.

When the fan member 45 is driven and rotated by the motor 75, the first centrifugal fan 51, the second centrifugal fan 56 and the third centrifugal fan 61 draw air in an axial direction, so that air is drawn into the scroll casing 32 from the suction port 34. The air stream in the axial direction is changed to an air stream in a radial direction by the first centrifugal fan 51, the first cylinder portion 54, the second centrifugal fan 56, the second cylinder portion 59, the third centrifugal fan 61 and the third cylinder portion 64.

Thereafter, air is blown toward radially outward, and is discharged from the discharge port 41 after flowing in a circumferential direction along the inner surface of the side wall 39 of the scroll casing 32. The air from the discharge port 41 is sent to the evaporator 80 and the heater core 82 by the centrifugal blower 30. Therefore, air is cooled in the evaporator 80 by performing heat exchange with refrigerant in a refrigerant cycle, and is heated in the heater core 82 by performing heat exchange with hot water (e.g., engine-cooling water).

According to the embodiment, the plate member 48 is constructed with the first, second and third circular plate portions 50, 55 and 60 and the first, second third cylinder portions 54, 59 and 64. That is, the air flow conditions can be made approximately the same between a first part constructed with the first circular plate portion 50 and the first cylinder portion 54, a second part constructed with the second circular plate portion 55 and the second cylinder portion 59, and a third part constructed with the third circular plate portion 60 and the third cylinder portion 64. Accordingly, the difference of the flow speed of air between different axial parts of the plate member 48 can be made smaller. Therefore, the flow amount of air can be made approximately uniform at the different parts (50, 55, 60) of the plate member 48. As a result, it can restrict the air stream from being disturbed due to the flow rate difference of air, thereby preventing a fan noise generation due to the disturbed air stream.

Furthermore, in this embodiment, the first centrifugal fan 51, the second centrifugal fan 56 and the third centrifugal fan 61 are formed on the surfaces of the first circular plate portion 50, the second circular plate portion 55 and the third circular plate portion 60, respectively. Therefore, a large amount of air can be drawn in the axial direction by the first, second and third fans 51, 56, 61. As a result, the discharge amount of air from the discharge port 41 of the centrifugal blower 30 can be effectively increased.

According to this embodiment, the first, second and third centrifugal fans 51, 56 and 61 and the first, second and third cylindrical portions 54, 59 and 64 have simple shapes. Therefore, the formation of the fan member 45 can be made easy in a low cost.

Furthermore, the positions of the stage portions 52, 57 and 62 of the centrifugal fans 51, 56, 61 on the first to third circular plate portions 50, 55, 60 are shifted from each other in the circumferential direction. Therefore, the difference of the air flow rate in the radial direction of each circular plate portion in the circumferential direction can be balanced and can be made smaller.

Figure 8:
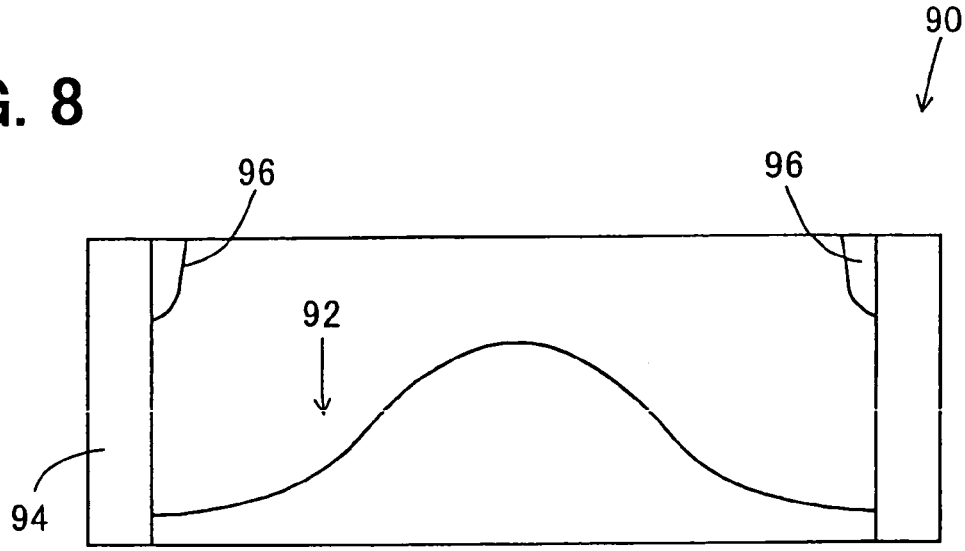
FIG. 8 is a schematic diagram showing a fan member in a comparison example.
Figure 9:
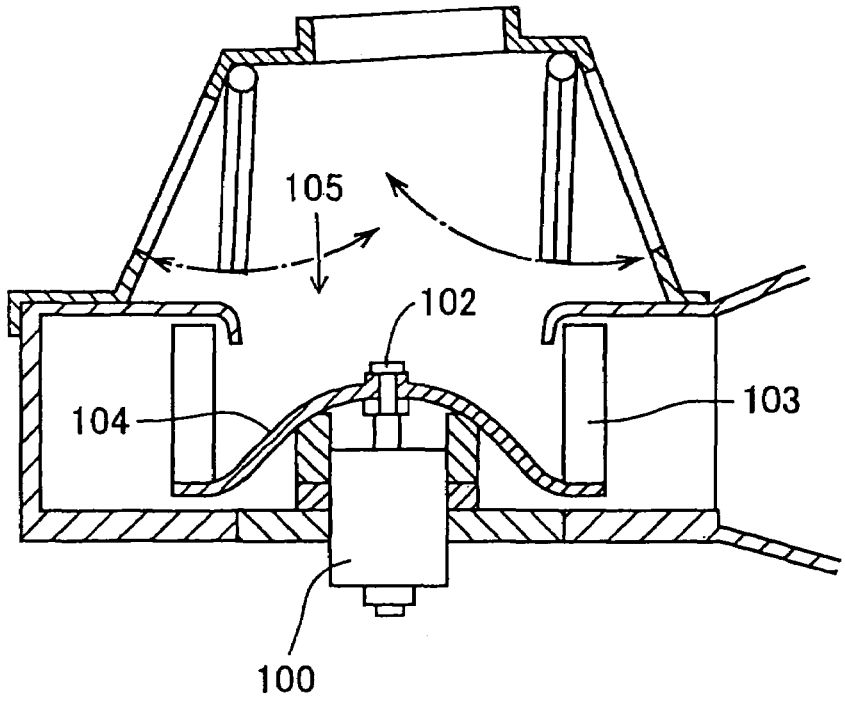
FIG. 9 PRIOR ART
FIG. 9 is a schematic sectional view showing a conventional centrifugal blower.
Figure 10:
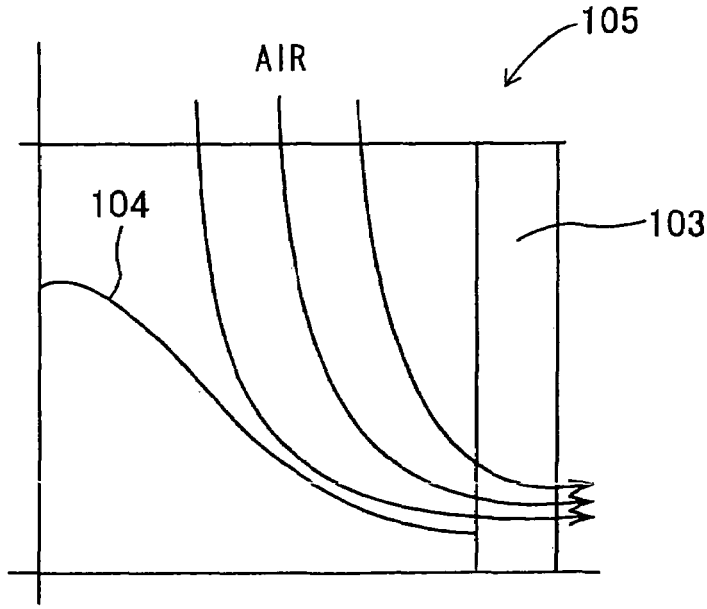
FIG. 10 PRIOR ART
FIG. 10 is a schematic diagram for explaining operation of the conventional centrifugal blower.

FIG. 8 shows a fan member 90 of a comparison example. The fan member 90 includes a mountain shaped plate member 92 (bottom plate), plural blades 94 at the outer periphery of the plate member 92, and an air suction fan 96 formed at each blade 94. The air suction fan 96 is formed adjacent to an upper end portion of each blade 94 to protrude to a radial inner side. When the fan member 90 operates, air is drawn in the axial direction, is reflected by the plate member 92, and is discharged to a radial outside. However, the blade 94 integrated with the air suction fan 96 has a complex shape, and is difficult to be molded. Each of the air suction fans 96 may be separately formed, and thereafter may be welded to the blade 94. However, in this case, the cost of the blades 94 with the fans 96 is increased.

Compared with the comparison example of FIG. 8, in the above-described embodiment of the present invention, the fan member 45 including the blades 70 and the plate member 48 can be easily formed with a simple structure.

OTHER EMBODIMENTS

Although the present invention has been described in connection with the embodiment thereof with reference to the accompanying drawings, it is to be noted that various changes and modifications will become apparent to those skilled in the art.

For example, in the above-described embodiment, the centrifugal blower 30 is used for a vehicle air conditioner in which a large pressure loss is generated in the air conditioning duct 10. However, the centrifugal blower 30 can be used for an air conditioner for a house, and can be used for the other use.

In the above-described embodiment, the centrifugal blower 30 is arranged such that an axial line of the motor 75 is positioned in a vertical direction as shown in FIG. 1. However, the centrifugal blower 30 can be arranged such that the axial line of the motor 75 is positioned in a direction (e.g., horizontal direction) except for the vertical direction.

In the above-described embodiment, the first to third circular plate portions 50, 55, 60 (i.e., three circular plate portions) are arranged in the axial direction to have the step shape in cross section. However, the number of the circular plate portions can be set at two or more to form a step shape in cross-section. Furthermore, the radial dimensions of the first to third circular plate portions 50, 55, 60 can be set to be equal or can be set different from each other.

The surface of each circular plate portion 50, 55, 60 can be made flat, or can be made to be bent in the circumferential direction of the centrifugal fan. Furthermore, the numbers of the fans 51, 56, 61 can be set at the same, or can be set to be different from each other.

Furthermore, stage portions 52, 57 and 62 extending in the radial direction can be arranged on the same position in the circumferential direction or can be offset from each other in the circumferential direction.

While the invention has been described with reference to preferred embodiments thereof, it is to be understood that the invention is not limited to the above-described embodiments and constructions. The invention is intended to cover various modification and equivalent arrangements. In addition, while the various elements of the preferred embodiments are shown in various combinations and configurations, which are preferred, other combinations and configuration, including more, less or only a single element, are also within the spirit and scope of the invention.

What is claimed is:

1. A centrifugal blower comprising:

a scroll casing defining a scroll passage having a suction port, from which air is drawn, and a discharge port from which air is discharged;

a fan member disposed rotatably in the scroll casing; and a motor which applies a rotation force to the fan member, wherein:

the fan member includes a plate member having at least a first circular plate portion and a second circular plate portion which are arranged in an axial direction to have a step shape in cross section, and a plurality of blades which are arranged at an outer peripheral portion of the plate member and extend in the axial direction; and the plate member is arranged to change a flow direction of air drawn by the fan member from the suction port in an axial direction, to a radial outside; wherein the fan member includes a plurality of centrifugal fans which are arranged on each of the first and second circular plate portions in a circumferential direction.

2. The centrifugal blower according to claim 1, wherein:

the plate member further has a third circular plate portion; and the first, second and third circular plate portions are arranged in the axial direction to have a step shape in cross section.

3. The centrifugal blower according to claim 1, wherein each of the centrifugal fans has a surface which protrudes toward the axial direction, and the protruding is made larger as toward the circumferential direction.

4. The centrifugal blower according to claim 3, wherein:

the centrifugal fans are arranged on the first circular plate portion to have a first stage portion between two centrifugal fans adjacent to each other in the circumferential direction;

the centrifugal fans are arranged on the second circular plate portion to have a second stage portion between two centrifugal fans adjacent to each other in the circumferential direction; and the first stage portion is offset from the second stage portion in the circumferential direction.

5. The centrifugal blower according to claim 1, wherein the first and second circular plate portions are arranged concentrically relative to an axial line of the fan member.

6. The centrifugal blower according to claim 1, further comprising a boss portion connected to a rotation shaft of the motor, wherein:

the first circular plate portion is connected to the boss portion and arranged around the boss portion; and the second circular plate portion is arranged at a portion shifted from the first circular plate portion in the axial direction to extend radially outward from the first circular plate portion.

7. The centrifugal blower according to claim 1, wherein the first and second circular plate portions have surfaces approximately perpendicular to the axial direction.

8. The centrifugal blower according to claim 1, wherein each of the first circular plate portion and the second circular plate portion defines an annular surface forming a gap in the radial direction between the annular surface and the plurality of blades.

* * * * *